United States Patent [19]

Furutsu

[11] Patent Number: 4,465,218

[45] Date of Patent: Aug. 14, 1984

[54] APPARATUS FOR ATTACHING TAG PINS

[75] Inventor: Akira Furutsu, Tokyo, Japan

[73] Assignee: Japan Bano'k Co., Ltd., Tokyo, Japan

[21] Appl. No.: 365,357

[22] Filed: Apr. 5, 1982

[30] Foreign Application Priority Data

Apr. 21, 1981 [JP] Japan ..... 56-59224

[51] Int. Cl.[3] ..... A41H 37/00

[52] U.S. Cl. ..... 227/67

[58] Field of Search ..... 227/67, 76, 100; 226/62, 70–72, 147, 151

[56] References Cited

U.S. PATENT DOCUMENTS 4,310,962 1/1982 Suzuki ..... 227/67

*Primary Examiner*—E. R. Kazenske
*Assistant Examiner*—Douglas D. Watts
*Attorney, Agent, or Firm*—Browdy and Neimark

[57] ABSTRACT

A tag attaching apparatus in which the push rod is advanced by the trigger lever operation into the hollow needle provided to the front portion of the body so as to cut off one by one the tag pins from the tag pin assembly. The feeding means for the tag pin assembly consists of a support plate moved by operation of the trigger lever and a feed lever oscillatably mounted to the support plate. A backtracking prevention means provided adjacent to the feeding means uses a spring to urge the stopper claw at the front end thereof to project into the guide groove.

6 Claims, 13 Drawing Figures

APPARATUS FOR ATTACHING TAG PINS

BACKGROUND OF THE INVENTION

This invention relates to a tag attaching apparatus and more specifically an apparatus for attaching a tag pin used when attaching a tag to merchandise.

Synthetic resin tag pins have been in use for attaching tags to articles. The tag pin consists of a head, a filament and a transverse rod, these three parts being formed integral using synthetic resin such as nylon and polypropylene. A plurality of these tag pins are attached to a base bar via connecting portions to form a tag pin assembly, which looks like a comb.

A tag attacher for driving these tag pins is shaped like a pistol. Every time a trigger lever of the pistolshaped tag attacher is pulled, the tag pins are separated one by one from the tag pin assembly. The transverse bar portion of each separated tag pin is then guided into a grooved hollow needle to penetrate through the tag and merchandise thereby attaching the tag to the merchandise. Conventional tag attachers, however, employ a gear to feed the tag pin assembly by engaging the teeth of the gear with the connecting portion of the tag pin assembly, so that if the pitch or the distance between tag pins does not match that of the gear teeth the tag pin assembly cannot be fed as desired.

SUMMARY OF THE INVENTION

The present invention has been achieved after continued research to overcome the above-mentioned drawback.

That is, the primary object of this invention is to provide a tag attaching apparatus that can be used with various tag pin assemblies with different pitches.

The other object of this invention is to provide a tag attaching apparatus which prevents the backtracking movement of the tag pin assembly thereby eliminating misshots.

Other features and advantages of this invention will become apparent in the course of the following explanation with reference to the attached drawings.

Concerning a tag attaching apparatus in which a push rod is advanced by the trigger lever operation into a hollow needle provided to the front portion of the body so as to cut off one by one the tag pins from the tag pin assembly inserted in the guide groove behind the hollow needle this invention is characterized in that a feeding means is provided behind the guide groove and consists of a support plate moved by the trigger lever operation and of a feed lever which is oscillatably mounted to the support plate and whose front end engagement claw is moved along the guide groove as the support plate is moved, and that a backtracking prevention means is provided adjacent to the feeding means in such a manner that its stopper claw projects into the guide groove.

According to this invention, since the engagement claw of the feeding means travels along the guide groove, tag pin assemblies of any pitch can be properly fed with this tag attaching apparatus. Moreover, the stopper claw of the backtracking prevention means holds the tag pin assembly thereby making it possible to prevent the tag pin assembly from backtracking and eliminate misshots.

DETAILED DESCRIPTION OF PREFERRED EMBODIMENTS

Figure 3:
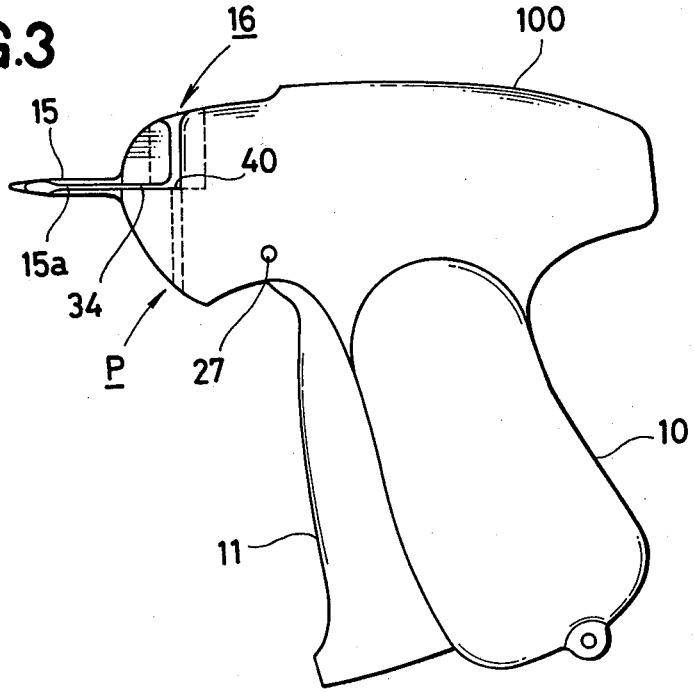
FIG. 3 is a side view of a tag attaching apparatus according to this invention.
Figure 4:
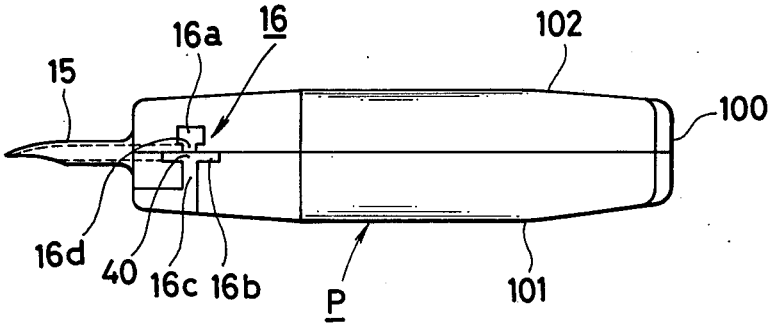
FIG. 4 is a plan view of the tag attaching apparatus of this invention.

The tag attaching apparatus P is shaped like a pistol as shown in FIG. 3 and its body 100 is formed of synthetic resin. The body 100 comprises a pair of body members 101, 102 as shown in FIG. 4 and a trigger lever 11 is pivotably supported on the body 100 by means of a shaft 27.

Figure 5:
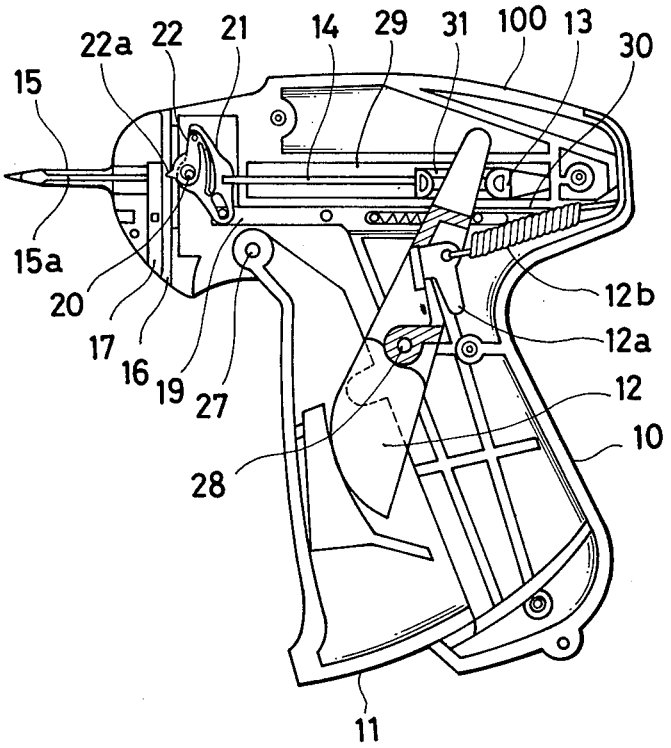
FIG. 5 is a front view showing the inside of one half of the tag attaching apparatus of this invention.

Referring to FIG. 5, rotatably mounted by a shaft 28 on a grip portion 10 of the body is an intermediate lever 12 which has a support member 12*a*. A spring 12*b* is attached between the support member 12*a* and the rear portion of the body 100 to bias the trigger lever 11 to project forward from the grip portion 10.

Slidably installed in a horizontal groove 29 formed in the body 100 is a slider 13 which has a push rod 14 secured to its front portion. A horizontal groove 30 is formed below and parallel to the groove 29 and in this groove 30 a slide bar 19 is slidably disposed. The upper end of the intermediate lever 12 fits into the slit 31 of the slider 13.

A hollow needle 15 formed with a longitudinal groove is attached to the body 100 at a position in front of the push rod 14. The hollow needle 15 is replaceable. A guide groove 16 into which to insert the tag pin assembly T is formed perpendicular to the hollow needle 15 at the position behind the needle 15.

As can be seen from FIGS. 3 and 4, the upper half of the guide groove 16 above the horizontal groove 15*a* of the hollow needle 15 is formed into a near cross shape.

Figure 1:
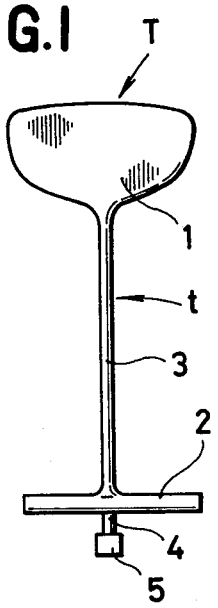
FIG. 1 is a front view showing one example of a tag pin assembly.
Figure 2:
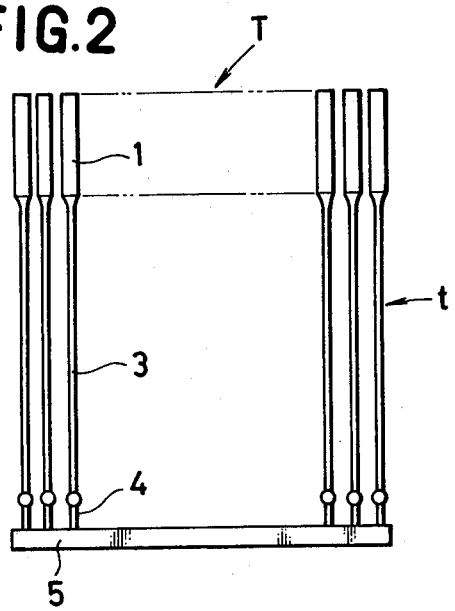
FIG. 2 is a side view of the tag pin assembly.

Now, referring to FIGS. 1 and 2, the tag pin assembly T will be explained. The tag pin t consists of three portions, i.e., a head 1, a transverse bar 2 and a filament 3 connecting the head and the transverse bar. A plurality of tag pins t are arranged in line on a base bar 5, like comb teeth, and they are connected through the connecting portion 4 to the base bar to form a tag pin assembly T which is formed integral as one part using synthetic resin such as nylon and polypropylene.

In FIGS. 3 and 4, reference numeral 16*a* represents a groove in which the base bar 5 of the tag pin assembly T is fed and reference numeral 16*d* represents a groove in which to feed the connecting portions 4, these two grooves vertically penetrating through the body 100. The grooves indicated by 16*b* and 16*c* are for the transverse bars 2 and the filaments 3 of the tag pins respectively. At the intersection between the grooves 16*b* and 16*c* is formed a support surface 40 which supports the transverse bars 2 of the tag pins t inserted into the guide groove 16. The axial groove 15*a* of the hollow needle 15 is connected to the guide grooves 16*b* and 16*c* through a communication groove 34.

Figure 6:
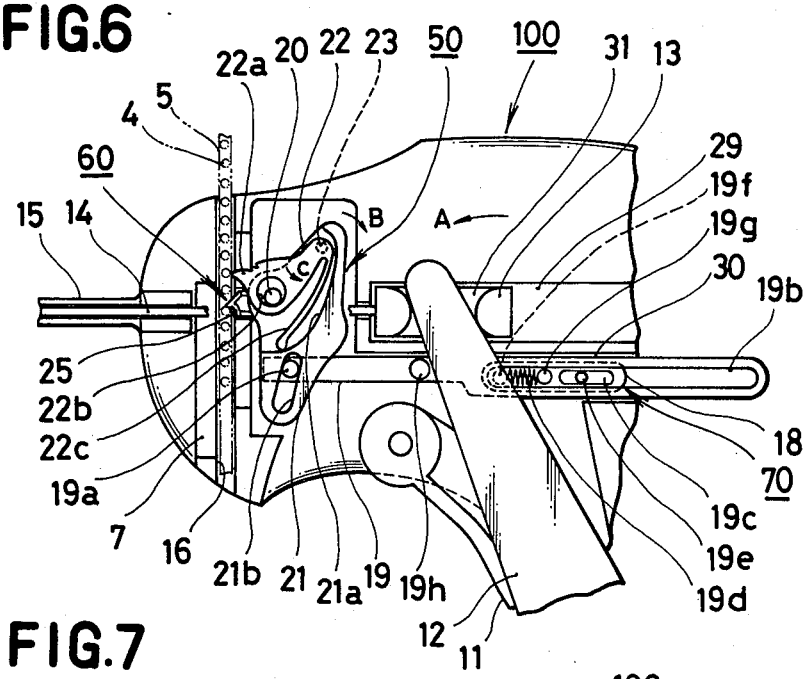
FIGS. 6 and 7 are enlarged front views of a mechanism for feeding the tag pin assembly.

Behind the guide groove 16 formed in the front portion of the body 100 a feeding means 50 and a backtracking prevention means 60 are provided. The feeding means 50 consists of a support plate 21 and a feed lever 22. The diamond-shaped support plate 21, as shown in FIG. 6, is oscillatably supported by a pin 20 on the body 100. The support plate 21 has a dent portion 21*a* at the upper portion on one side (the side on which the guide groove 16 is provided) in which the feed lever 22 is oscillatably mounted by a pin 23. The feed lever 22 has an engagement claw 22*a* to engage with the connecting portion 4 of the tag pin.

The feed lever 22 has formed at the lower portion thereof a hole 22*b* larger than the head of the pin 20 projecting from the dent portion 21*a*. The hole 22*b* of the feed lever 22 is fitted over the head of the pin 20 so that the feed lever 22 can oscillate about the pin 23 relative to the support plate 21 through the gap formed between the hole 22*b* and the head of the pin 20.

Figure 10:
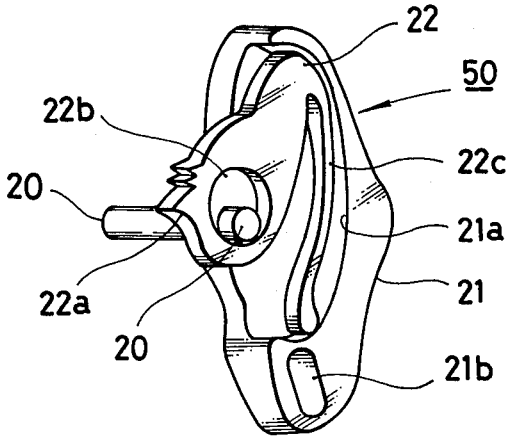
FIG. 10 is a perspective view of the tag pin feeding means.
Figure 11:
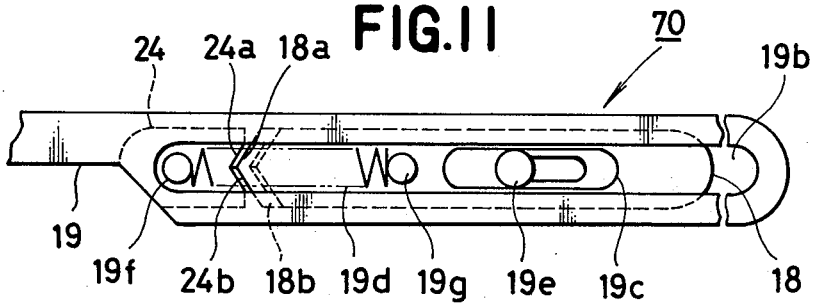
FIG. 11 is a front view of a forced-feed prevention means.

The feed lever 22 also has a resilient or elastic member 22*c* formed integral with the upper portion thereof, the free end of which extends downward below the lower portion of the feed lever 22 and abuts against the side wall of the dent portion 21*a* to urge the engagement claw 22*a* toward the guide groove 16. Hence, the feed lever 22 oscillates together with the support plate 21 with respect to the body 100, while it also is pivoted about the shaft 23 in the direction indicated by the arrow C of FIG. 6. The relationship between the support plate 21 and the feed lever 22 may more clearly be understood by referring to FIG. 10.

The support plate 21 has an upwardly inclined slit 21*b* at the lower portion thereof into which a projection 19*a* provided at the side of the front portion of the slide bar 19 (reciprocated back and forth by the intermediate lever 12) is loosely fitted so that the forward and backward movement of the slide bar 19 causes the support plate 21 to oscillate about the pin 20.

Figure 8:
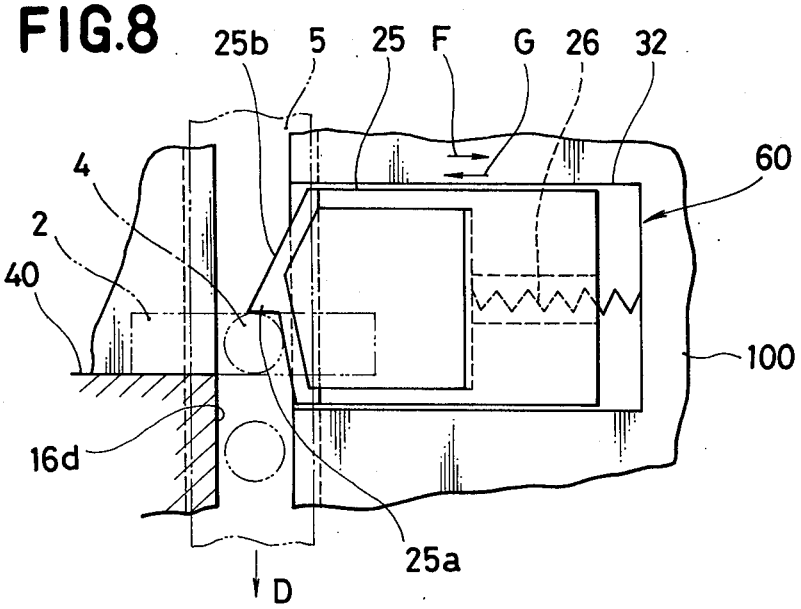
FIG. 8 is an enlarged front view of a stopper for preventing a backtracking movement of the tag pin assembly.

As shown in FIG. 6 and FIG. 8, a tag pin assembly backtracking prevention means 60 is provided adjacent to the feeding means 50. The backtracking prevention means 60 has a backtracking prevention member 25 and a spring 26, with the backtracking prevention member 25 located behind the guide groove 16 at the position corresponding to where the tag pin is driven into the article.

The backtracking prevention member 25, as shown in FIG. 8, is slidably disposed in the slide groove 32 formed in the inner wall of the body 100. The backtracking prevention member 25 is biased by a spring 26 so as to project its stopper claw 25*a* into the guide groove 16*d*.

Figure 9:
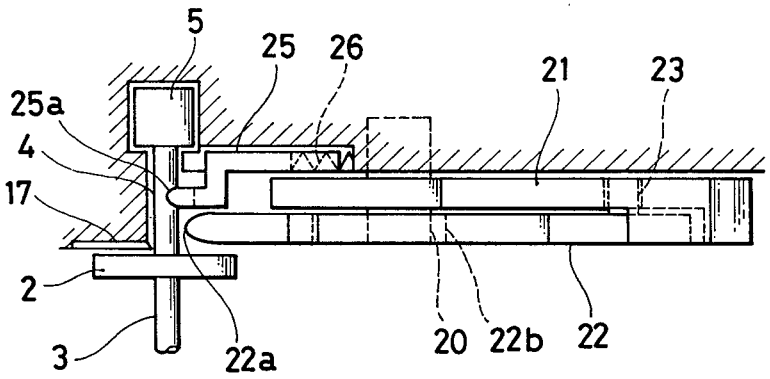
FIG. 9 is a partially cross-sectional plan view showing the relation between the tag pin feeding means and the tag pin backtracking prevention means.

The stopper claw 25*a* has on its upper portion an inclined surface 25*b* against which abuts the connecting portion 4 of the tag pin as the tag pin assembly is fed, thereby retracting the backtracking prevention member 25 to the right. When the tag pin assembly T is about to backtrack, the stopper claw 25*a* holds the tag pin t immovable at the position where the transverse bar 2 of the tag pin t is immediately behind the rear opening of the hollow needle 15. The backtracking prevention member 25, as shown in FIG. 9, has its stopper claw 25*a* bent toward the engagement claw 22*a* of the feed lever 22 so that it faces the short connecting portion 4 of the tag pin. A cutter 17 is provided in front of the guide groove 16 to cut off the tag pin t from the connecting portion 4.

Figure 7:
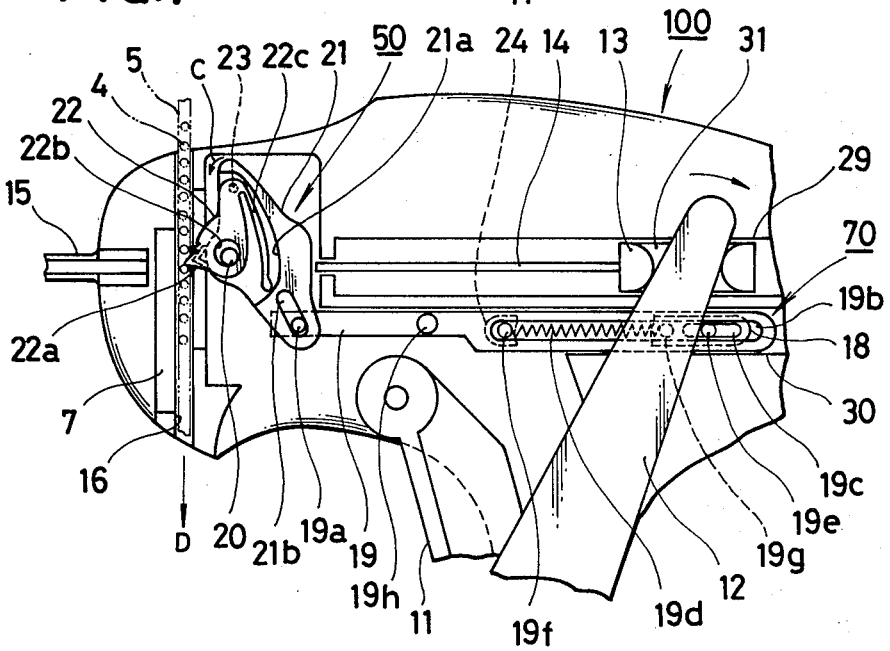
Figure 12:
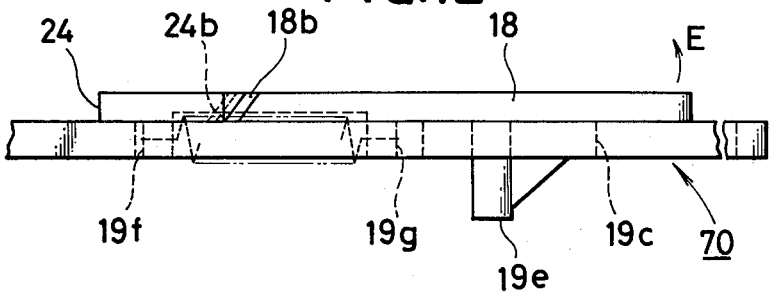
FIG. 12 is a plan view of the forced-feed prevention means.

The slide bar 19 is provided with a forced-feed prevention means 70 which comprises, as shown in FIG. 7, a slit 19*b*, a moving piece 19*c*, a spring 19*d*, a projection 19*e*, support members 19*g*, 19*f*, a guide plate 18, and a stopper 24. The moving piece 19*c* is slidably installed in the slit 19*b* formed in the slide bar 19. The guide plate 18 to which the moving piece 19*c* is fixed prevents the moving piece 19*c* from being dislocated. Disposed in front of the moving piece 19*c* is a spring 19*d* the front end of which is attached to the support member 19*f* and the rear end to the support member 19*g*. The support member 19*f* is held by the stopper 24 so as to project into the slit 19*b* and the support member 19*g* is secured to the guide plate 18. The stopper 24, formed integral with the slide bar 19, is positioned at the front end of the slit 19*b* on the back of the slide bar 19 (see FIG. 12). The stopper 24 has at its rear end a V-shaped recess 24*a* which constitutes an engagement portion 24*b*. On the other hand, the guide plate 18 has at its front end a pointed portion 18*a* that constitutes another engagement portion 18*b*, which when brought into contact with the mating engagement portion 24*b* prevents the rotation of the slide bar in the direction illustrated by the arrow E.

Projections 19*h* and 19*e* are provided to the slide bar 19 and to the moving piece 19*c*, respectively, so that the intermediate lever 12 will abut against these projections 19*e*, 19*h*.

Next, the operation of the above apparatus will be explained.

When the tag pin t is to be driven into article, the intermediate lever 12 is rotated in the direction illustrated by the arrow A and this causes the slider 13 to advance pushing the transverse bar 2 of the tag pin into the hollow needle 15 by the push rod 14 so as to penetrate the tag pin through article such as clothes. At the same time, the intermediate lever 12 pushes the projection 19*h* forward advancing the slide bar 19 with the result that the support plate 21 rotates about the pin 20 in the direction indicated by the arrow B thereby retracting the feed lever 22 to the engagement position.

In this process when the engagement claw 22*a* of the feed lever 22 contacts the connecting portion 4 of the tag pin a small force acts upon the connecting portion 4 to cause the base bar 5 to backtrack, though at this time the feed lever 22 is rotated about the pin 23 in the direction indicated by the arrow C of FIG. 6 (i.e., the engagement claw 22*a* moves away from the connecting portion 4). However, there is no possibility of the base bar 5 being moved back since the connecting portion 4 of the tag pin is held immovable by the stopper claw 25*a* of the backtracking prevention member 25.

Then, after one tag pin t is driven into an article, the grip on the lever is released, the intermediate lever 12 rotates in the direction opposite to the previous direction thus restoring the push rod 14 and the slide bar 19 to their home positions (see FIG. 7). As the slide bar 19 returns to its original position, the support plate 21 is rotated in the reverse direction as indicated by the arrow C through the engagement between the pin 19*a* and the slit 21*b*. This brings the engagement claw 22*a* of the feed lever 22 into engagement with the connecting portion 4 of the tag pin to feed the base bar 5 in the direction of arrow D in FIG. 7. As a result the tag pin assembly T is fed as much distance as that between the previous tag pin t that has been removed and the one being fed, until the transverse bar 2 of the lowest tag pin t being fed contacts the support surface 40. During this process the backtracking prevention member 25 is retracted in the direction of arrow F by the tag pin assembly feeding force against the force of the spring 26 but as soon as the tag pin has moved past the head of the stopper claw 25*a* the backtracking prevention member 25 advances in the direction indicated by the arrow G and holds the connecting portion 4 against the backtracking movement.

The restoration of the intermediate lever 12 to its home position is accomplished forcibly by the spring 12*b*. As the intermediate lever 12 returns to its home position, the moving piece 19*c* is moved rearward against the force of the spring 19*d* thereby pressing the lowest tag pin t against the support surface 40 with an almost constant pressure.

In this way a series of tag pins t are successively driven into articles until the tag pins run out.

Figure 13:
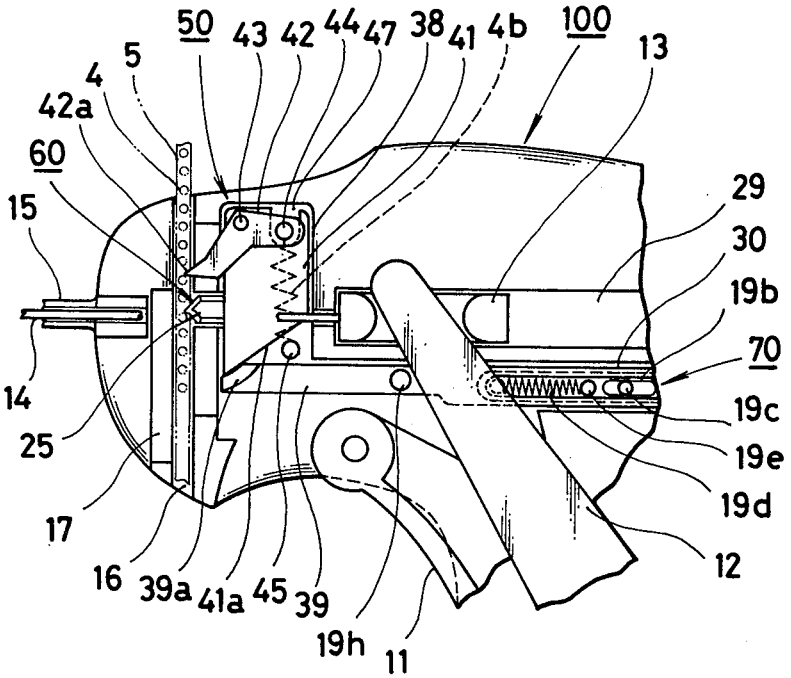
FIG. 13 is an enlarged front view showing another embodiment of the tag pin assembly feeding mechanism.

It should be noted that the means for feeding the tag pin assembly T is not limited to the above embodiment. For example, the tag pin assembly feeding means may be constructed as shown in FIG. 13, in which a support plate 41 is provided in the body which is moved along the guide groove 16 by the slide bar 39 and the feed lever 42 is oscillatably mounted to the support plate 41 whereby after a tag pin has been driven the engagement claw 42*a* of the feed lever 42 comes into engagement with the connecting portion 4 of the tag pin and then the feed lever 42 is moved together with the support plate 41 along the guide groove 16.

The second example of the feeding means described above is simple in construction as compared to the first example. That is, as shown in FIG. 13, the support plate 41 is mounted vertically movable in the dented portion 38 formed behind the guide groove 16. The support plate 41 has an inclined cam surface 41*a* which is placed in contact with the cam portion 39*a* at the front end of the slide bar 39. The feed lever 42 is oscillatably mounted by the pin 43 to the support plate 41 with the engagement claw 42*a* at the front end of the feed lever adapted to project into the guide groove 16*d*. Between the shaft 44 at the rear end of the feed lever 42 and the pin 45 secured to the body 100 there is provided a spring which urges the support plate 41 downward. A notch 47 is cut in the support plate 41 at a location corresponding to the shaft 44 to allow a slight rotation of the feed lever 42. As with the first example, the backtracking prevention means 60 and the forced-feed prevention means 70 are also provided in this example. Other members in the second example that are identical to those in the first example of the tag attaching apparatus are assigned identical reference numerals.

Next, the operation of the second embodiment of the tag attaching apparatus will be explained.

As the intermediate lever 12 approaches the forward end of its stroke, the cam portion 39*a* of the slide bar 39 comes into contact with the cam surface 41*a* of the support plate 41 thereby lifting the support plate 41 against the force of the spring 46. At this time the feed lever 42 is also lifted along with the support plate 41. As the support plate 41 is lifted, the feed lever 42 is pulled by the spring 46 to be rotated about the pin 43 thus projecting the engagement claw 42*a* into the guide groove 16, so that the engagement claw 42*a* applies a slight upward force to the connecting portion 4 of the tag pin urging the base bar 5 to move up. With the stopper claw 25*a* of the backtracking prevention member 25 holding the connecting portion 4, however, the base bar 5 is prevented from backtracking.

Next, when a grip on the lever 11 is released, the slide bar 39 returns to its home position permitting the support plate 41 to be lowered by the action of the spring 46. This causes the feed lever to move down with the engagement claw 42*a* engaging the connecting portion of the tag pin, so that the tag pin assembly T is fed downward.

It should be noted that the present invention is not limited to the embodiments described above and that various modifications can be made without departing the spirit and scope of this invention as defined in the appended claims.

I claim:

1. A tag attaching apparatus comprising a body having a hollow needle mounted at a front end portion thereof, a guide groove therein for receiving tag-pins of a tag-pin assembly one at a time, the guide groove being formed in the body in the vicinity of and in communication with a base end of the hollow needle; means for feeding said tag-pins disposed in the vicinity of the guide groove for advancing tag-pins of a loaded tag-pin assembly, one at a time, to a position adjacent to the base end of the hollow needle, and a backtracking prevention means including a stopper claw disposed also in the vicinity of the guide groove, said feeding means and said backtracking prevention means being disposed parallel to each other, said feeding means including an engagement claw rockably supported thereon, said engagement claw being rockable from a position on one side of said stopper claw to a position beyond said stopper claw in the direction in which the tag-pins are advanced during feeding.

2. A tag attaching apparatus as claimed in claim 1, wherein said feeding means comprises a support plate rockably supported by the body and a feed lever pivotally supported to the support plate, said engagement claw being supported on said feed lever and being adapted to project beyond the support plate by an elastic arm member.

3. A tag attaching apparatus as claimed in claim 1, wherein said backtracking prevention means comprises a backtracking prevention member slidably mounted in the body by a spring biasing the backtracking prevention member to project toward the guide groove.

4. A tag attaching apparatus as claimed in claim 2, wherein said support plate is operatively connected to a slide bar mounted in said body and having a forced-feed prevention means comprising a slit formed in the slide bar, a stopper disposed in a from end portion of the slit, a guide plate engageable with the stopper, a moving piece secured on the guide plate and projecting into the slit, a spring extending between the slide bar and the guide plate, and a lever-supporting projection secured on the moving piece.

5. A tag attaching apparatus as claimed in claim 4, wherein said slide bar has a cam portion formed at a front end portion thereof, which is engageable with said feeding means to reciprocably move the latter parallel to the guide groove, the feeding means comprising a support plate having a notch in an upper end portion thereof, a feed lever pivotably mounted on the support plate, a shaft, secured to said feed lever and said body, and extending through the notch of the support plate, a spring bridging the shaft and a pin secured to the body, and a cam surface formed in a portion of the support plate for engaging said cam portion of the slide bar.

6. In an apparatus for dispensing tag-pins of a loaded tag-pin assembly, the apparatus including means for engaging a tag-pin of the assembly and advancing it to a dispensing station and means for preventing back-tracking of the tag-pin after being advanced, said advancing means and said preventing means being disposed parallel to one another, the improvement comprising:

said advancing means having a tag-pin engaging surface ang being supported by said body for pivoting motion between a first position wherein said surface is positioned above said preventing means to a second position where said surface is disposed below said preventing means, the pivoting motion of said advancing means urging said tag-pin to be dispensed from a first location above the preventing means to a second location at said dispensing station.

* * * * *